US005505049A

United States Patent [19]

Coyle et al.

[11] Patent Number: 5,505,049

[45] Date of Patent: Apr. 9, 1996

[54] PROCESS FOR REMOVING NITROGEN FROM LNG

[75] Inventors: David A. Coyle; Felix J. Fernandez de la Vega; Charles A. Durr, all of Houston, Tex.; Ashutosh Rastogi, New Delhi, Ind.

[73] Assignee: The M. W. Kellogg Company, Houston, Tex.

[21] Appl. No.: 437,623

[22] Filed: May 9, 1995

[51] Int. Cl.[6] ..... F25J 3/00

[52] U.S. Cl. ..... 62/11; 62/41

[58] Field of Search ..... 62/11, 41

[56] References Cited

U.S. PATENT DOCUMENTS

| | | | |
|---|---|---|---|
| 2,500,129 | 3/1950 | Laverty et al. . | |
| 2,823,523 | 2/1958 | Eakin et al. . | |
| 3,203,191 | 8/1965 | French . | |
| 3,559,418 | 2/1971 | Hoffman . | |
| 3,874,184 | 4/1975 | Harper et al. . | |
| 4,225,329 | 9/1980 | Bailey et al. . | |
| 4,242,875 | 1/1981 | Schaefer | 62/11 |
| 4,334,902 | 6/1982 | Paradowski . | |
| 4,638,639 | 1/1987 | Marshall et al. | 62/9 |
| 5,036,671 | 8/1991 | Nelson et al. . | |

OTHER PUBLICATIONS

Finn, A., *Chemical Engineering,* vol. 101, No. 5, pp. 142–147, May 1994.

Costain Oil, Gas & Process, Ltd. Plate Fin Exchanger Bulletin, 1989, pp. 5–9.

*Primary Examiner*—Ronald C. Capossela

*Attorney, Agent, or Firm*—The M. W. Kellogg Company

[57] ABSTRACT

A process for removing nitrogen from liquefied natural gas (LNG) using an enhanced surface, reflux heat exchanger is disclosed. A relatively warm high pressure LNG stream is directed countercurrently in heat exchange with a cool low pressure LNG stream to chill the high pressure stream and partially vaporize the low pressure LNG stream in the reflux heat exchanger. Vapor produced thereby strips the low pressure LNG stream of nitrogen. The cool low pressure LNG stream is produced by expansion of the chilled high pressure LNG stream. Vapor produced by the expansion is combined with the vapor produced in the exchanger and withdrawn overhead. Product LNG which is lean in nitrogen is withdrawn from the bottom of the exchanger.

7 Claims, 1 Drawing Sheet

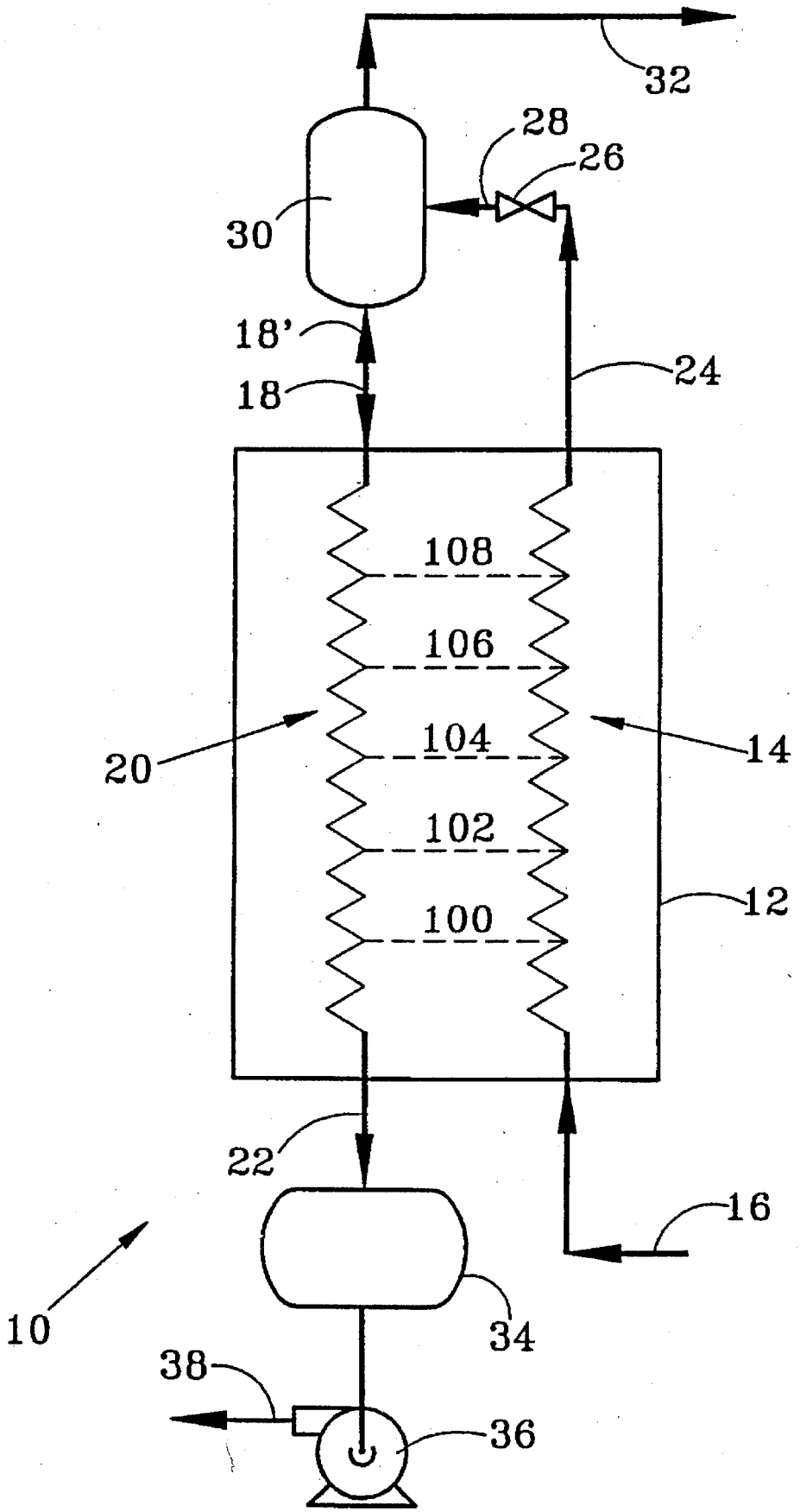
32
28
26
30
18'
18
24
108
106
104
102
100
20
14
12
22
16
10
34
38
36

PROCESS FOR REMOVING NITROGEN FROM LNG

FIELD OF THE INVENTION

The present invention relates to a process for removing nitrogen from liquefied natural gas (LNG) using a reflux or plate-fin heat exchanger.

BACKGROUND OF THE INVENTION

Various methods and techniques for dealing with nitrogen in natural gas liquefaction are known. Some examples include U.S. Pat. Nos. 2,500,129 to Laverty et al.; 2,823,523 to Eakin et al.; 3,559,418 to Hoffman; 3,874,184 to Harper et al.; 4,225,329 to Bailey et al.; and 5,036,671 to Nelson et al. Most of these involve fractionation and/or separation of a nitrogen rich vapor stream from a partially condensed natural gas stream.

Recent advances in the manufacture of plate fin heat exchangers now permit the use of such devices in place of conventional distillation columns in some cryogenic processes including air separation; recovery of hydrogen, ethylene, natural gas liquids and liquefied petroleum gases; and purification of carbon dioxide. Also known as reflux exchangers, both heat and mass transfer operations can be simultaneously effected at high efficiency. A reflux heat exchanger typically has a high ratio of surface area to volume for a light, compact design preferably operating with a minimum temperature driving force of only 2° to 3° C.

A reflux exchanger includes adjacent passages for introducing feed and heat transfer fluids. A liquid feed stream preferably is introduced for downward gravity flow through a feed passage and a heating fluid flows upward through an adjacent heat transfer passage so that the streams are countercurrent to each other. Heat transferred to the downflowing stream effects vaporization of at least part thereof. Vapor thus formed rises up through the same passages as the feed stream to strip the liquid phase of the lightest components. The feed vapor phase is then withdrawn overhead from the feed passage.

In this arrangement, the reflux exchanger resembles the stripping section of a distillation column. However, important differences are evident. Heat exchange coincident with separation along the entire length of the unit permits the driving forces for both heat and mass transfer to remain small for enhanced thermodynamic efficiency. Because the driving forces are small, temperature and compositional differences between vapor and liquid phases more closely represent a reversible thermodynamic process. The reflux exchanger is thus analogous to a multistage stripper having a feboiler at each stage.

A reflux exchanger as a multistage stripper offers a few other benefits over an ordinary distillation column as well. In an ordinary partial vaporization (stripping) process, the feed is heated to a sufficiently high temperature to ensure that most of the lighter components are vaporized out and recovered. This can result in a relatively large amount of unwanted heavier components being vaporized into the vapor phase. In contrast, a reflux exchanger with a lower average reboil temperature has lesser amounts of vaporized heavy components. Consequently, the heating load is reduced because of the reduction in the heat load for reboil. Alternatively, for the same reboil load, better recoveries can be achieved.

It can be seen that for a vapor feed stream, a similar exchanger can be analogously employed as a multistage rectifier. A coincident cooling source at each stage condenses the feed and refluxes the vapor.

A general overview of a plate-fin heat exchanger and the use thereof in natural gas processing is disclosed in Finn, A., *Chemical Engineering*, Vol. 101, No. 5, pp. 142–147, May 1994.

Costain Oil, Gas & Process, Ltd. Plate Fin Exchanger Bulletin of 1989, pgs. 5–9, describes sizing calculations used to design a plate-fin heat exchanger.

U.S. Pat. No. 3,203,191 to French describes a gas liquefaction process employing an expander to lower energy requirements.

U.S. Pat. No. 4,334,902 to Paradowski describes a process for liquefying natural gas by cooling the gas with the vapor from a liquid coolant subcooled after expansion thereof in the liquid condition wherein the vapor simultaneously subcools the liquefied coolant. The subcooled high pressure liquid coolant is expanded in a hydraulic turbine.

SUMMARY OF THE INVENTION

Nitrogen removal from liquefied natural gas (LNG) is efficiently effected by substituting a reflux plate-fin exchanger for a conventional nitrogen separation column to achieve energy savings and reduced capital costs.

As one embodiment, the present invention provides a nitrogen removal process useful in a natural gas liquefaction plant for removing nitrogen from a relatively warm high pressure liquid stream comprising at least 80 mole percent methane and up to 20 mole percent nitrogen. As step (a), the relatively warm high pressure liquid stream is cooled in an enhanced surface heat exchanger against a relatively low pressure liquefied natural gas stream to form a relatively cool high pressure liquid stream and partially vaporize the low pressure liquefied natural gas stream. As step (b), the relatively cool high pressure liquid stream from step (a) is expanded to form a further cooled mixture of liquid and vapor. As step (c), the mixture from step (b) is fed to a separator to form a liquid stream and a vapor stream. As step (d), the liquid stream from step (c) is supplied to the heat exchanger in step (a) as the relatively low pressure stream which is partially vaporized to form a fluid of enhanced nitrogen content and a liquid product stream lean in nitrogen. As step (e), the low pressure liquefied natural gas stream in the heat exchanger is countercurrently contacted with the fluid vaporized in the heat exchanger to strip nitrogen therefrom. As step (f), the fluid vaporized in the heat exchanger is supplied to the separator in step (c). As step (g), the vapor stream enriched in nitrogen content is recovered from the separator.

In a preferred embodiment, the heat exchanger in steps (a), (d) and (e) comprises a plate fin exchanger. The relatively warm high pressure liquid stream has a temperature from about −165° C. to about −130° C. and a pressure from about 1 MPa to about 5 MPa, and the liquid product stream and the vapor stream from the separator have a pressure from about 0.1 MPa to about 0.5 MPa. The liquid product stream is collected in a holding tank. The low pressure liquefied natural gas stream gravity flows downwardly through the heat exchanger in passages sized to facilitate the upward flow of vaporized fluid.

In one arrangement, the expansion step (b) is preferably done with a Joule-Thomson valve. In another arrangement, the expansion step (b) is preferably done with a liquid expander.

BRIEF DESCRIPTION OF THE DRAWING

The FIGURE is a schematic diagram of an LNG nitrogen removal process of the present invention using a reflux heat exchanger.

DETAILED DESCRIPTION OF THE INVENTION

A plate-fin/reflux heat exchanger can be advantageously used in place of a conventional distillation column in a process for removing nitrogen from liquid natural gas due to a sufficiently large difference in the relative volatility between nitrogen and methane so as to avoid requiring too many stages and too great a reboil rate.

Referring to the FIGURE, a nitrogen separation unit 10 comprises an enhanced surface heat exchanger 12 preferably comprising a vertically oriented plate-fin exchanger employed as a multi-stage stripper. The plate-fin exchanger 12 includes a first passage 14 having a line 16 for introducing a relatively warm high pressure liquid stream. The warm high pressure stream 16 preferably comprises LNG with a composition of at least 80 mole percent methane and up to 20 mole percent nitrogen, a temperature between about −165° C. to −130° C. and a pressure between about 1 MPa and about 5 MPa.

Flowing upward through the first passage 14 of the plate-fin exchanger 12, the relatively warm high pressure LNG stream 16 is progressively cooled by an exchange of heat against a relatively cool low pressure LNG stream introduced through a line 18 flowing generally downward under gravity through an adjacent second passage 20 of the plate-fin exchanger 12.

In the practice of the present invention, heat continuously exchanged from the relatively warm high pressure upflowing liquid stream 16 to the relatively cool low pressure downflowing liquid stream 18 partially vaporizes the low pressure liquid stream 18. A vapor phase of the stream 18 rich in light components such as nitrogen passes upward in intimate contact with the downflowing liquid phase of the stream 18 to strip the liquid phase of additional remaining light components such as nitrogen. A liquid product stream lean in light components like nitrogen is removed from the exchanger 12 through line 22.

Heat is transferred to the low pressure liquid stream 18 in the second passage 20 to continuously cool the warm high pressure liquid stream 16 in the first passage 14 so that a relatively cool high pressure liquid stream is withdrawn through line 24. The cool high pressure liquid stream 24 is then reduced in pressure by expansion generally by a Joule-Thomson valve 26 to further cool the stream 24 and partially vaporize the lightest components.

A low pressure, multiphase stream in line 28 is fed to a separator drum 30 to separate the liquid and vapor phases. The separated liquid phase is directed through line 18 as the cool low pressure liquid stream to the exchanger 12 mentioned above. Coincident to the introduction of the cool low pressure liquid to the exchanger 12, the vapor stream flowing upward through the second passage 20 passes into the separation drum 30 also through line 18 and is combined with the vapor phase separated from the multi-phase stream 28. A combined vapor stream rich in lightest components such as nitrogen is withdrawn through line 32.

In the case of a process for nitrogen separation from LNG, a nitrogen-lean LNG product stream is withdrawn through line 22 and a nitrogen-rich gas stream is withdrawn through line 32. The LNG product stream 22 can be held-up in a storage drum 34 feeding a pump 36 having a high pressure discharge line 38. The nitrogen-rich gas stream 32 can be used as fuel gas.

In an alternative embodiment, the expansion valve 26 can be replaced with a liquid expander (not shown) to recover work from the expansion of the liquid stream 24 and save compression energy expended elsewhere in the process.

Design and manufacture of plate-fin heat exchangers are well known in the art. Such exchangers are typically fabricated of brazed aluminum, but can also be make from other materials such as stainless steel. Plate-fin heat exchangers typically operate in a countercurrent fashion with countercurrent flow of the relatively warm and cool liquid streams 16, 18 through the first and second flow passages 14, 20.

The process of the present invention is further illustrated by reference to the following example:

EXAMPLE

An LNG nitrogen removal process as seen in the FIGURE was computer modeled using ASPENPLUS software. Initial simulation setup comprised a RADFRAC block with 5 stages, 100, 102, 104, 106 and 108, each stage having an interreboiler. Pressure drop per stage of the first passage 14 was set at 11 KPa. Other input parameters are given in TABLE 1.

TABLE 1

| Inlet stream: | Attribute |
|---|---|
| Flowrate (mol/hr) | 18511.1 |
| Temperature (°C.) | −149.0 |
| Pressure (MPa(a)) | 1.990 |
| Composition (mol %): | |
| He | 0.060 |
| $N_2$ | 4.212 |
| $C_1$ | 87.788 |
| $C_2$ | 5.241 |
| $C_3$ | 1.733 |
| $iC_4$ | 0.352 |
| $nC_4$ | 0.550 |
| $iC_5$ | 0.055 |
| $nC_5$ | 0.009 |
| Temperature Distribution First Passage 14 (°C.) | |
| 5th stage 108 | −161.0 |
| 4th stage 106 | −159.0 |
| 3rd stage 104 | −157.0 |
| 2nd stage 102 | −156.0 |
| 1st stage 100 | −154.0 |
| Pressure drum 30 (MPa(a)) | 0.125 |

Relatively warm high pressure LNG from the main exchanger for natural gas liquefaction is introduced through line 16 to the first passage 14 of a stripping reflux exchanger 12 wherein the relatively warm LNG stream is chilled. The warm high pressure LNG stream has a composition of about 4.212 mol % $N_2$ and 87.788 mol % $C_1$. A chilled high pressure LNG stream is withdrawn from the exchanger 12 through line 24 at a temperature of −161° C. The LNG stream is expanded to 0.125 MPa(a) and has a corresponding temperature of −165.8° C. Following separation of the vapor phase, a chilled low pressure liquid LNG stream is reintroduced to a second passage 20 of the exchanger through line 18. In the exchanger 12, the chilled low pressure LNG stream 18 is reheated and partially vaporized. After reheating, a liquid low pressure LNG stream stripped of nitrogen by the vapor produced therein leaves the exchanger at −158.5° C. through line 22 as a product LNG stream. The LNG product stream 22 comprises approximately 0.391 mol % $N_2$, 90.814 mol % $C_1$ and 8.795 mol % $C_2$–$C_5$. A nitrogen-rich vapor stream 32 including the vapor 28 produced on letdown and the vapor 18' produced in the exchanger 12 comprises about 39.750 mol % $N_2$ and 59.628 mol % $C_1$.

A summary of results are presented in TABLE 2. In addition, results indicated that no pinch points occur between the process and coolant sides. The cross-sectional area of the exchanger including a sum of the area of both sides was calculated to be approximately 1.4 $m^2$.

TABLE 2

| | LNG product stream 22 | Vapor stream 32 |
|---|---|---|
| Flowrate (mol/hr) | 16714.3 | 1796.8 |
| Temperature (°C.) | −158.5 | −164.3 |
| Pressure (MPa(a)) | 0.133 | 0.125 |
| Composition: | | |
| He | 0 | 0.618 |
| $N_2$ | 0.391 | 39.750 |
| $C_1$ | 90.814 | 59.628 |
| $C_2$ | 5.804 | 0.004 |
| $C_3$ | 1.920 | 0 |
| $iC_4$ | 0.390 | 0 |
| $nC_4$ | 0.610 | 0 |
| $iC_5$ | 0.061 | 0 |
| $nC_5$ | 0.010 | 0 |
| Temperature Distribution Second Passage 20 (°C.) | | |
| 5th stage 108 | −164.3 | |
| 4th stage 106 | −162.6 | |
| 3rd stage 104 | −161.2 | |
| 2nd stage 102 | −159.8 | |
| 1st stage 100 | −158.5 | |
| Heat Input (Q) per Stage (kw) | | |
| 5th stage 108 | 555 | |
| 4th stage 106 | 568 | |
| 3rd stage 104 | 289 | |
| 2nd stage 102 | 584 | |
| 1st stage 100 | 1505 | |

The present nitrogen removal process is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

We claim:

1. A nitrogen removal process useful in a natural gas liquefaction plant for removing nitrogen from a relatively warm high pressure liquid stream comprising at least 80 mole percent methane and up to 20 mole percent nitrogen, comprising the steps of:

(a) cooling the relatively warm high pressure liquid stream in an enhanced surface heat exchanger against a relatively low pressure liquefied natural gas stream to form a relatively cool high pressure liquid stream and partially vaporize the low pressure liquefied natural gas stream;

(b) expanding the relatively cool high pressure liquid stream from step (a) to form a further cooled mixture of liquid and vapor;

(c) feeding the mixture from step (b) to a separator to form a liquid stream and a vapor stream;

(d) supplying the liquid stream from step (c) to the heat exchanger in step (a) as the relatively low pressure stream which is partially vaporized to form a fluid of enhanced nitrogen content and a liquid product stream lean in nitrogen;

(e) countercurrently contacting the low pressure liquefied natural gas stream in the heat exchanger with the fluid vaporized in the heat exchanger to strip nitrogen therefrom;

(f) supplying the fluid vaporized in the heat exchanger to the separator in step (c); and (g) recovering the vapor stream from the separator, wherein the vapor stream is enriched in nitrogen content.

2. The nitrogen removal process of claim 1, wherein the heat exchanger in steps (a), (d) and (e) comprises a plate fin exchanger.

3. The nitrogen removal process of claim 1, wherein the relatively warm high pressure liquid stream has a temperature from about −165° C. to about −130° C. and a pressure from about 1 MPa to about 5 MPa, and the liquid product stream and the vapor stream from the separator have a pressure from about 0.1 MPa to about 0.5 MPa.

4. The nitrogen removal process of claim 1, wherein the expansion step (b) is effected with a Joule-Thomson valve.

5. The nitrogen removal process of claim 1, wherein the expansion step (b) is effected with a liquid expander.

6. The nitrogen removal process of claim 1, further comprising collecting the liquid product stream in a holding tank.

7. The nitrogen removal process of claim 1, wherein the low pressure liquefied natural gas stream gravity flows downwardly through the heat exchanger in passages sized to facilitate the upward flow of vaporized fluid therethrough.

* * * * *